United States Patent [19]

Jette

[11] 4,394,969

[45] Jul. 26, 1983

[54] SHOWERHEAD CONTROL

[76] Inventor: Emile Jette, 1328 NE. 110 Ter., Miami, Fla. 33161

[21] Appl. No.: 233,209

[22] Filed: Feb. 10, 1981

Related U.S. Application Data

[63] Continuation-in-part of Ser. No. 219,851, Dec. 31, 1980, abandoned, which is a continuation-in-part of Ser. No. 868,200, Jan. 9, 1978, Pat. No. 4,273,289, which is a continuation-in-part of Ser. No. 863,694, Dec. 29, 1977, abandoned, which is a continuation-in-part of Ser. No. 790,277, Apr. 25, 1977, abandoned, which is a continuation-in-part of Ser. No. 743,766, Nov. 22, 1976, abandoned.

[51] Int. Cl.[3] ..... B05B 1/18; B05B 1/32; B05B 7/00

[52] U.S. Cl. ..... 239/414; 137/637; 239/460; 239/537; 239/574; 239/578; 239/579; 239/587

[58] Field of Search ..... 137/625.41, 637, 637.3; 239/414, 587, 537, 460, 578, 579, 574

[56] References Cited

U.S. PATENT DOCUMENTS

| | | | |
|---|---|---|---|
| 595,014 | 12/1897 | Doolittle | 239/537 X |
| 2,285,831 | 6/1942 | Pennypacker | 239/460 |
| 3,047,239 | 7/1962 | Canavan | 239/460 X |
| 3,726,318 | 4/1973 | Hyde | 137/625.41 |
| 4,200,123 | 4/1980 | Brandelli | 239/587 X |
| 4,273,289 | 6/1981 | Jette | 239/587 X |

FOREIGN PATENT DOCUMENTS

| | | | |
|---|---|---|---|
| 1291297 | 10/1972 | United Kingdom | 137/625.41 |

*Primary Examiner*—Andres Kashnikow

[57] ABSTRACT

A showerhead device assembly, independent of the need for faucet or faucets, including an extending control operator for controlling waterflow, water temperature and spray, comprising, a main housing having a passageway between a discharge mouth and an inlet providing a separate hot and cold water chamber for pivotal connection to a showerarm having a hot water port and a cold water port including discharges and an inlet connection, to a hot and cold water supply, including a first water temperature and flow control structure and a second waterflow and spray control structure connected with the extending operator, enabling a user to shut off and turn on waterflow through the showerhead, adjust the temperature of the water flowing therethrough and adjust the spray texture and direction by movement of the operator.

9 Claims, 5 Drawing Figures

10c
38c
24c
24'c
28c
213c
18c
145
33
42c
34c
20c
12c
2
4
104c
170c
148
144c
26c
3
75
22c
42'c
8
180c
143
140
73
30c
146c
202c
26'c
74c
71
32c
204c
147
172c
102c
70c
141
170'c
47
206c
45
66
65c
61
49
211c
46c
208c
102'c
182c
60c
62c
100c
64'
108c
110c
112c
16c
14c
24c
24'c
14'c
ω

SHOWERHEAD CONTROL

CROSS-REFERENCES TO RELATED APPLICATIONS

This application is a continuation -in-part of application Ser. No. 219,851 filed Dec. 31, 1980, now abandoned, which is a continuation-in-part of application Ser. No. 868,200, filed Jan. 9, 1978, now U.S. Pat. No. 4,273,289 which is a continuation-in-part of Ser. No. 863,694, filed Dec. 29, 1977, now abandoned, which in turn is a continuation-in-part of application Ser. No. 790,277, filed Apr. 25, 1977, now abandoned, which in turn is continuation-in-part of application Ser. NO. 743,766, field Nov. 22, 1976, now abandoned.

In the U.S. Patent Office, Washington, D.C. "Disclose Document Program", this device disclosure number is 078,005 Filed Feb. 8, 1979.

BACKGROUND OF THE INVENTION

1. Field of the Invention

The present invention generally relates to showerheads for distributing water received from a water supply line. More particularly, the invention relates to showerheads having means for controlling the direction and volume of waterflow and water spray texture and temperature therethrough.

2. Description of the Prior Art

Showerheads are generally connected to a source of water supply by a ball and socket connection, the ball being fixed to the end of a water supply pipe, projecting outwardly of a wall in a bathtub or shower enclosure. The connection is provided in the showerhead in a manner so as to permit universal movement of the showerhead, relative to the fixed ball.

Generally, individual hot and cold water faucets or a single lever type of faucet is connected to hot and cold water conduits from sources of supply. The faucet or faucets must be manipulated to a proper hot and cold water mixture to achieve a desired water temperature. The mixed water then enters a single conduit to the showerhead where it passes through a discharge port in the connector ball and then outwardly in a spray form through any one of a variety of spray structures, depending upon the mixer of the spray head. A newer type of spray head provides a plurality of spray outlets, three or four for example, with manual adjustment means to control the mixture of hot and cold water to the single outlet port in the connector ball to a selected spray outlet.

To adjust the direction of the spray, a user must physically grasp any of the single or multiple outlet spray heads, provided with the above described ball and socket connections, and turn it to a desired position. If a user desires to shut off the water supply while applying soap or shampoo, the faucet or faucets must be turned off and then turned on and readjusted to the desired hot and cold water mixture for the rinsing operation. Since bathtub and shower enclosures are generally limited in size, it is very difficult to avoid the shower spray while applying soap or shampoo.

SUMMARY OF THE INVENTION

The present invention solves the aforementioned problems of known devices by providing an improved showerhead which is capable of controlling water temperature and flow, spray direction and spray texture by the manual actuation of a single elongate control operator at a distance away from the showerhead spray. The showerhead basically comprises housing having a flow passage therethrough, universal pivotal ball and socket means for connection to a shower arm first portion having an insulated hot water path and a cold water path including means for connection to a second hot and cold water shower arm mounting portion having means for threaded connection to hot and cold water supply lines and the first arm including a spherical ball and socket head portion having hot and cold water ports extending through the head at a 45 arc, each, discharging from the other into separate hot and cold chambers from which the amount of hot and cold water is metered by a disc valve arrangement means through separate hot and cold water bores in the housing to control water temperature therethrough to a spray control means structure spanning the housing discharge mouth, provided having means to vary the texture of the spray land shut out waterflow through the water bores. The housing is capable of universal pivoting movement within predetermined limits to permit water flow through the passage in at least one pivoted position and terminate water flow through the passage in at least one pivoted position. The spray control means includes an exterior ring gear surface and is screwthreadedly connected to the outlet end of the flow passage for varying spray texture. The housing includes a water temperature control structure defining a partition and a water control disc having ring gear means to be controlled by an elongate control operator is provided with a first end carried by the housing and a second free distal end. The operator in part comprising an elongate rod having a first end carried by the housing and included having pinion gear means provided on the first end mated for engagement with ring gear means about the periphery of the control disc to control water temperature and the second distal end including a clutch pin transfersly fixed therethrough, with the longitudinal axis of the control operator diverging outwardly from the longitudinal axis of the showerhead, and a sleeve telescopically mounted over the rod carries pinion gear means on the upper end mated for engagement with the spray texture and closes water passage through the bores by vertical movement to engage the pinion gear with the ring gear and rotational movement of the sleeve to rotate the spray structure for varying texture and an enlarged portion carried on the lower end having a clutch slot mated to receive the rod clutch pin thereby holding the sleeve in fixed relation to the rod allowing water temperature adjustment without distributing the preadjusted spray texture without changing the preadjusted water temperature. Manual actuation of the control operator at its free distal end by a user, permits pivoting of the main housing about its connection to the shower arm to control water flow through the passage and spray direction, with water temperature and spray texture being controlled upon rotational and vertical movement of the control operator about its longitudinal axis.

Therefore, one of the principal objects of the present invention is to provide an improved showerhead having a control operator that includes a distal handle portion which, upon actuation, serves to not only control water flow through the showerhead and spray direction, but also spray texture.

Another object of the invention is to provide a showerhead capable of terminating water flow therethrough and also adjust the water temperature by actuation of the operator.

It is a further object of the invention to provide an improved showerhead which is capable of controlling water flow, spray direction, spray texture and temperature through the manual actuation of a single control operator means at a distal point at all times away from the water spray wherein a faucet or faucets are not needed.

These and other objects and advantages of the present invention will become apparent to those skilled in the art by reference to the following description of preferred embodiments thereof when taken in conjunction with the accompanying drawings wherein like reference characters refer to like elements throughout views.

BRIEF DESCRIPTION OF THE DRAWINGS

The embodiment of this invention is shown in FIG. 1. As seen in FIG. 1 the instant embodiment assembly includes a shower arm assembly, generally indicated at 8, defining a shower arm neck portion 380 and a shower arm bracket 160, a showerhead control assembly at 100 comprising a main housing 280 having a water temperature control structure defining a partition 1460 and a disc 141 having a peripheral ring grear 148 and a center through opening 140 spanning a through passageway between an inlet 73 and a screw-threaded discharge mouth 74C, having a spray diffuser structure 61 providing a decorative ring gear surface screw-threadedly connected to the mouth 74C and an elongate control operator 60C comprising an elongate rod 62C having a first end 65C carried by an extended bearing and pinion gear housing 46C a portion of the housing 28C and included having pinion gear 102C melans on the first end 65C mated for engagement with ring gear means 148 provided about the periphery of the disc 141 to control water temperature by rotational movement of rod 62C and the second distal end 110C having a clutch pin 108C transversly fixed therethrough and included on the first end 65C, an annular groove is provided to receive a set screw means 45 threaded into the extended housing 46C to retain rod 62C from vertical movement and housing 46C carried seal means 47 to prevent a water leakage through the rod 62C bearing means 49 and operator 60C includes an elongate sleeve 100C telescopically mounted over the rod 62C carrying pinion gear means 102C' on the upper end mated for engagement with the spray means structure ring gear 104C to vary spray texture and close water passage through openings 170C and 170C' by vertical and rotational movement of the sleeve enlarged portion 64C carried on the lower end having clutch means slot 112C mated to receive the rod clutch pin 108C thereby holding the sleeve 100C in fixed relation to the rod in a telescopic down position allowing water temperature adjustment without distrubing the preadjusted spray texture and in the opposite, with the sleeve 100C in a telescopic shown position and pin 108C is clutched in slot 112C permit varying of the preadjusted spray texture without changing the preadjusted water temperature.

Figures 1, 2, 3, 4, 5:
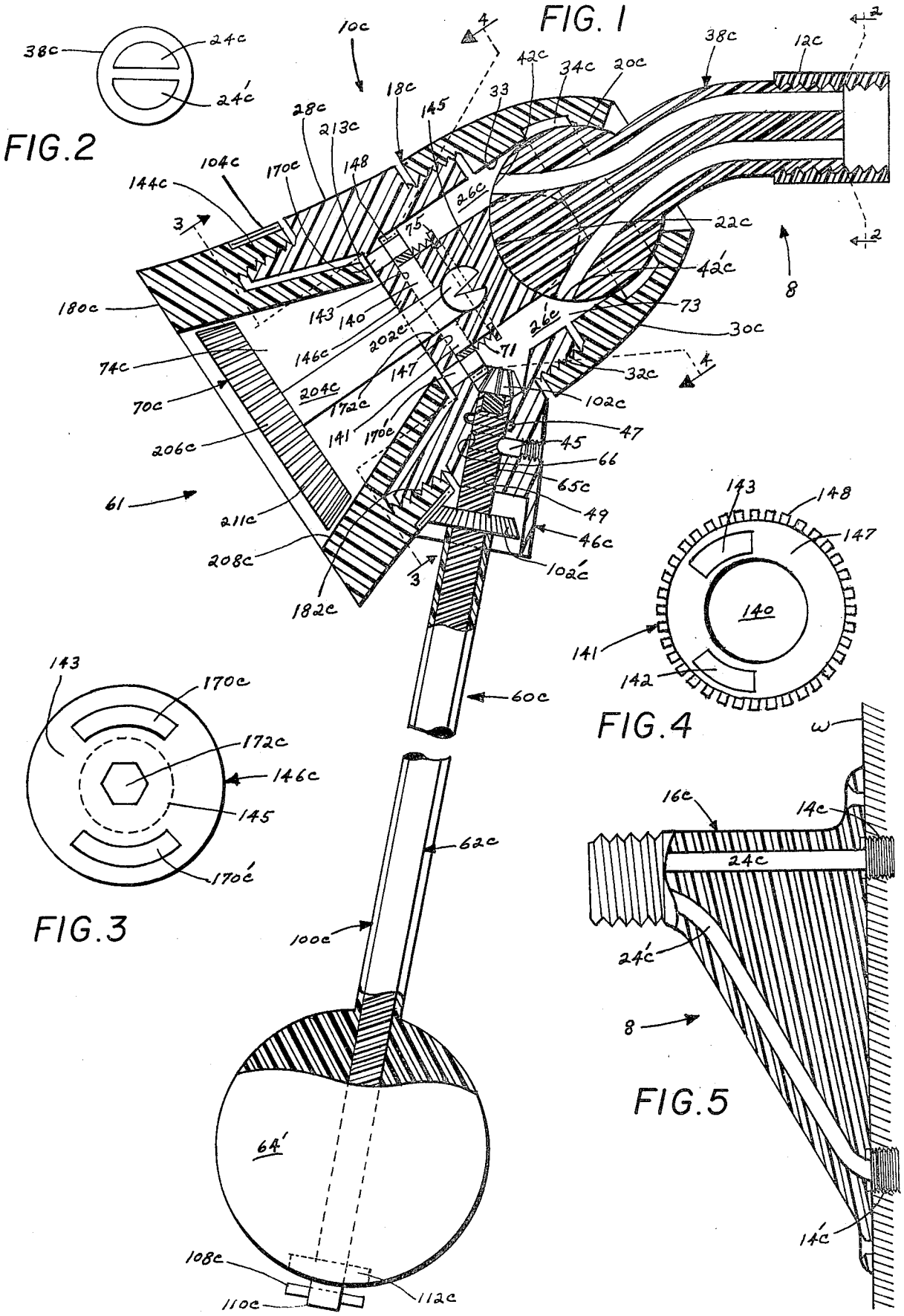
FIG. 1 is an enlarged fragmentary view of a fifth embodiment of the present invention depicting the showerhead in a "water-on" position.
FIG. 2 is a view taken along the broken lines 2—2 of FIG. 1 and looking in the direction of the arrows.
FIG. 3 is a view taken along the broken lines 3—3 of FIG. 1 and looking in the direction of the arrows.
FIG. 4 is a view taken along the broken lines 4—4 of FIG. 1 and looking in the direction of the arrows.
FIG. 5 is a fragmentary view of the showerhead device mounting portion, depicting hot and cold water supply line connection means.

Shown in FIG. 1, neck 38C is coupled at 12C to bracket 16C seen in FIG. 5 including separate connecting means at 14C and 14C' for connection to hot and cold water supply pipes provided in a shower stall wall. The neck 38C and bracket 16C include an insulated hot water port 24C and a cold water port 24C' running lthe longitudinal length of the shower arm assembly 8 and having inlets at 14C and 14c' and discharge openings 42C and 42C' through a ball 20C portion of neck 38C discharging opposite each other at predetermined diverging angles into a hot water chamber 26C provided by an extended chamber separator 145 portion of partition 146C spanning the passageway.

As seen in FIG. 1 chamber separator 145 defining an extended member portion of from partition 146C being a diameter less than through opening 140 and includes seal and socket means provided on the terminal spherical segment surface 22C. Partition 146C defining a water temperature control valve means surface portion 143, a hot water through opening 170C and a cold water through opening 170C' discharging into mouth 74C and included is a center connector opening 172C to receive and captivate in fixed rigid position a barbed surface 202C carried on the terminal end 200C of an irregular shaped extended stem 204C portion of a water selection disc 70C portion of structure 61 to prevent rotational movement of disc 170C and disc 70C having an exterior frustoconical peripheral surface 206C providing annular grooves 211C spaced intermediate the surface 206C and structure 61 including an annular body 180C defining a frustoconical skirt having a terminal sopen end 213C and an inner correspondingly shaped frustoconical surface 208C to the disc surface 206C and a screw-threaded opening 182C for screw-threaded connection with screwthreaded 144C of mouth 74C, providing screwthreaded movement of body 180C defining a variable annular opening there between when body 180C is screwthreadedly moved toward and away from surface 206C and a hot and cold water flow closed position when terminal end 213C is moved toward partition 146C to close through openings 170C and 170C'.

As seen in FIG. 4, a water temperature control disc 141 defining a center through opening 140 being a diameter larger then member 145, a hot water through opening 143 and a cold water through opening 142, a water control valve means surface 147 mated to valve means surface 143 and a peripheral ring gear surface 148. Disc 141, when rotationally moved in the opposite direction, openings 143 and 142 will constrict opening 170C' and enlarge opening 170C, thus controlling water temperature therethrough. When disc 141 is rotationally moved to a predetermined position, openings 170C and 170C' are closed thereby controlling water temperature and additionally water flow therethrough.

As shown in FIG. 1, showerhead 10C includes the ball 20C universally journaled within inlet 73 and socket 22C being held captive by means of a connector cap 30C which is threaded onto the inlet 73 of housing 28C as at 32C and the inner surface 33 of cap 30C provides ring seal means 34C to prevent backflow of water between the inner surface 33 and ball 20C and to provide a degree of frictional engagement with ball 20C.

When housing 28C is moved pivotally within a predetermined universal range the socket surface 22C will close discharge 42C' and the cap inner surface 33 will close discharge 42C and the cap inner surface 33 will close discharge 42C.

A annular pressure spring 71 having an inside diameter a diameter larger than the diameter of chamber separator member 145 is mounted about member 145 to place pressure means on disc 141 and being retained in pressure position by a snap ring 75 to insure tight contact of temperature valve surfaces, surface 133 to surface 147.

This embodiment provides three different valve means combinations defining, pivotal valve means to stop water flow including control of spray direction, valve means to stop water flow including water temperature adjustment and valve means to stop water flow including spray texture varying means which may all be incorporated or effective if provided separately in a showerhead.

What is claimed is:

1. A showerhead device assembly including means for controlling temperature and the flow of water therethrough pivotally connected by a ball and socket means to a shower arm having separate hot and cold water passages extending therethrough comprising:

A. A main housing having passage means between an inlet and a discharge portion including separate hot and cold water chambers divided by a first partition, a water temperature and flow control means in the form of a second partition positioned at the downstream end of said chambers for varying the temperature and volume of water leading to the discharge portion and screwthreads at its downstream end;

B. The discharge portion including connection means for engaging a valve and spray producing means;

C. The valve and spray producing means comprising:

(a) an annular frustoconical skirt shaped body having an inner surface and an upstream end adapted to contact said second partition to shut off the flow of water, (b) a disc having a frustoconical peripheral surface with a plurality of grooves, said grooves cooperating with the inner surface of said skirt shaped body to define outlet passages, and a stem extending in an upstream direction for connecting the disc to the first partition, (c) the connection means comprising screwthreads for cooperation with the screwthreads of said main housing whereby by screwthreading said valve and spray producing means to said main housing the texture of the spray exiting said outlet passages can be varied and the flow of water past said second partition can be shut off by contacting said second partition with the upstream end of said skirt shaped body; and D. An elongate control means having an upper end carried by said main housing and connected to said second partition and to said valve and spray producing means for;

(a) varying the volume and temperature of the water leading to the discharge portion;

(b) moving the valve and spray producing means with respect to said main housing to vary the spray texture of the spray exiting said outlet passages; and (c) varying the direction of the spray by moving the socket with respect to the ball of said ball and socket means.

2. The showerhead device of claim 1 wherein the upper end of said elongate control means is carried by an extension of said main housing.

3. The showerhead device of claim 1 wherein the valve and spray producing means has a first ring gear on an external surface and wherein said elongate control means includes a first pinion gear for engaging said first ring gear and transmitting rotational movement of the elongate control means thereto to move said valve and spray producing means with respect to said main housing.

4. The showerhead device of claim 3 wherein said second partition includes two openings, one for cooperation with said hot water chamber and the other for cooperation with said cold water chamber, and wherein said first partition includes a concave surface defining the socket of said ball and socket means, the shower arm providing the ball of said ball and socket means, and wherein a disc valve is disposed between said first and second partitions having a hot water opening and a cold water opening, said disc valve including a peripheral ring gear adapted to be engaged by a second pinion gear carried by said elongate control means whereby rotational movement of said elongate control means is transmitted to said disc valve to move the disc valve openings into and out of alignment with the second partition openings.

5. The showerhead device of claim 4 wherein spring means are used to urge the valve disc into contact with the second partition.

6. The showerhead device of claim 4 wherein a cap is screwthreaded to said main housing, said cap captivating said ball and maintaining it in engagement with said socket.

7. The showerthread device of claim 4 wherein the elongate control means includes an elongate rod member having an upper and a lower end, and an elongate sleeve having an upper and a lower end, said sleeve being mounted in free vertical and rotational movement over said rod member wherein:

(a) the upper end of said rod member includes said second pinion gear;

(b) the lower end of said rod member includes a pin fixed transversely to said lower end;

(c) the upper end of said sleeve includes said first pinion gear;

(d) the lower end of said sleeve terminating in an enlarged handle having a slot sized to receive said pin when said sleeve is moved to a down position; and (e) seal means between the upper end of said rod member and said main housing.

8. The showerhead device of claim 7 wherein the upper end of said rod member includes an annular groove adapted to receive a set screw carried by said main housing.

9. The showerhead device of claim 4 wherein the hot and cold water passages extending through said ball discharge at an acute angle into the hot and cold water chambers when said main housing is pivoted to one position, and wherein when said main housing is pivoted to another position the hot and cold water passages are blocked close by the socket and by a surface of the retainer cap.

* * * * *